US008605914B2

(12) United States Patent
Neoran

(10) Patent No.: US 8,605,914 B2
(45) Date of Patent: Dec. 10, 2013

(54) NONLINEAR FILTER FOR SEPARATION OF CENTER SOUNDS IN STEREOPHONIC AUDIO

(75) Inventor: Itai Neoran, Beit-Hannanya (IL)

(73) Assignee: Waves Audio Ltd., Tel Aviv (IL)

( * ) Notice: Subject to any disclaimer, the term of this patent is extended or adjusted under 35 U.S.C. 154(b) by 486 days.

(21) Appl. No.: 12/988,393

(22) PCT Filed: Apr. 19, 2009

(86) PCT No.: PCT/IL2009/000422

§ 371 (c)(1),
(2), (4) Date: Oct. 18, 2010

(87) PCT Pub. No.: WO2009/128078

PCT Pub. Date: Oct. 22, 2009

(65) Prior Publication Data

US 2011/0038485 A1 Feb. 17, 2011

Related U.S. Application Data

(60) Provisional application No. 61/071,211, filed on Apr. 17, 2008.

(51) Int. Cl.
*H04R 5/00* (2006.01)

(52) U.S. Cl.
USPC ..... 381/27; 381/1; 381/300

(58) Field of Classification Search
USPC ..... 381/1, 17, 18, 19, 20, 23, 27, 300, 307, 381/98–100, 119, 21, 22
See application file for complete search history.

(56) References Cited

U.S. PATENT DOCUMENTS 4,748,669 A 5/1988 Klayman
4,799,260 A 1/1989 Mandell (Continued)

FOREIGN PATENT DOCUMENTS

EP 1 784 048 A2 5/2007
GB 394325 6/1933
JP A 7-007800 1/1995

OTHER PUBLICATIONS

Griesinger, "Stereo and Surround Panning in Practice," Audio Engineering Society 112$^{th}$ Convention, Convention Paper 5564, May 10-13, 2002, pp. 1-6.

(Continued)

*Primary Examiner* — Vivian Chin
*Assistant Examiner* — Friedrich W Fahnert
(74) *Attorney, Agent, or Firm* — Oliff & Berridge, PLC

(57) ABSTRACT

In accordance with some embodiments of the present invention there is provided a system, a method and a circuit for processing a stereo audio signal. According to some embodiments, the system for processing a stereo audio signal may include an audio processing circuit. The audio processing module or circuit may be operatively connected to an audio input interface and to an output audio interface. Through the audio input interface, the audio processing circuit may be adapted for receiving a 2-channels stereo audio signal. The audio processing module may be adapted for determining an output mono audio signal representing the center sound and a stereo audio signal representing the stereo sound without the center. Through the output interface the audio processing circuit may provide each of an output mono audio signal representing the center sound and a stereo audio signal representing the stereo sound without the center.

13 Claims, 5 Drawing Sheets

(56) References Cited

U.S. PATENT DOCUMENTS

| | | | | |
|---|---|---|---|---|
| 5,386,473 | A * | 1/1995 | Harrison | 381/306 |
| 5,610,986 | A * | 3/1997 | Miles | 381/27 |
| 5,872,851 | A * | 2/1999 | Petroff | 381/18 |
| 6,198,826 | B1 * | 3/2001 | Cowieson et al. | 381/18 |
| 6,219,426 | B1 * | 4/2001 | Daniels et al. | 381/307 |
| 6,697,491 | B1 * | 2/2004 | Griesinger | 381/20 |
| 7,035,413 | B1 * | 4/2006 | Waller et al. | 381/17 |
| 2006/0159190 | A1 | 7/2006 | Wu et al. | |
| 2008/0031463 | A1 * | 2/2008 | Davis | 381/17 |

OTHER PUBLICATIONS

Gardner, "Historical Background of the Haas and/or Precedence Effect," The Journal of the Acoustical Society of America, vol. 43, No. 6, 1968, pp. 1243-1248.

Bernfeld, "Attempts for Better Understanding of the Directional Stereophonic Listening Mechanism," 44$^{th}$ Audio Engineering Society Convention, Feb. 20-22, 1973, pp. 1-24.

* cited by examiner

NONLINEAR FILTER FOR SEPARATION OF CENTER SOUNDS IN STEREOPHONIC AUDIO

CROSS REFERENCE TO RELATED APPLICATIONS

This application claims the benefit of U.S. Provisional Patent Application Ser. No. 61/071,211, filed on Apr. 17, 2008.

FIELD OF THE INVENTION

The present invention relates to processing of stereophonic audio signals having two or more frontal channels.

BACKGROUND OF THE INVENTION

Conventional reproduction of stereophonic audio on two loudspeakers dates back to the 30's with the invention of Blumlein stereo (British Pat. No. GB394,325). In accordance with the teachings of Blumlein an audio signal is recorded and transmitted as a set of two channels, allowing each of two synchronized loudspeakers to reproduce a different audio signal, where the phase differences and amplitude differences between the two signals generate imaginary sound-source locations to the listener's ears. These imaginary sound-sources are referred to in the art as 'phantom images'. The totality of phantom images is commonly referred to as the 'stereo image'.

The invention of stereo and phantom images revolutionized audio reproduction technologies. For example, by maintaining certain relations between the signals in the two stereo channels, the perceived direction of each phantom-image could be designated such that it closely corresponds to the direction of the real source in a recorded acoustic environment, as long as that direction is not to the left of the leftmost loudspeaker or to the right of the rightmost loudspeaker. Using stereo related technology it is also possible to generate a stereo signal from a mono signal (one channel), in a way that the mono sound source will appear as a phantom image in a desired direction, by simply routing the mono signal into both channels of the stereo, and by manipulating the relative amplitudes of the channels or their relative delays. The latter method is commonly referred to as 'panning' and is described in greater detail in Griesinger D., Stereo and Surround panning in practice, 112 Audio Engineering Society Convention, Germany 2002 (hereinafter "Griesinger").

In conventional stereo, the perceived direction of a phantom image in steady-state sound is determined by the phase-difference between the channels in low frequencies, and by the amplitude differences between the channels in high frequencies, as is described in greater detail in Bernfeld B., Attempts for better understanding of the directional stereophonic listening mechanism, 44th Audio Engineering Society Convention, February 1973 (hereinafter "Bernfeld"). On transient sounds, if there is a delay difference between the transients in the two channels, then inter-channel delay and HAAS effect are also involved in the perceived phantom direction, as is described in greater detail in Gardner M. B, Historical background of the Haas and or precedence effect, J. of Acoustical Society of America, No. 43, 1968 (hereinafter "Gardner M. B").

Many alternative two-or-more-loudspeakers audio reproduction methods have been proposed in prior art. Still, conventional stereo remains the most popular method. In conventional stereo reproduction, mainly 3 procedures (or their combination) are used to obtain a stereophonic audio signal: (1) Stereo is recorded as two channels via a stereophonic microphone technique, (2) A single mono channel is recorded and stereo is generated from the mono channel by amplitude panning as described above, and (3) A single mono channel is recorded and artificial effects (such as artificial reverberation, delay effects, phase effects, HRTF ("Head Related Transfer Functions") filters) are used to generate artificial two-channel stereo. Other methods also exist. For all 3 procedures described here, sounds may appear to the listener to arrive from the center position between the loudspeakers. This effect is called "phantom center" and is generally perceived only when the two-channel signals in the stereo contain a part of the signal which relates to "direct sound" and that part is identical or almost identical in the two channels (see Bernfeld B. referenced in the previous section). Phantom center differs from "hard-center" which is an attempt to reproduce sound arriving from the center using an additional (typically a $3^{rd}$) loudspeaker positioned in-between the left and right frontal speakers and substantially in front of the listener.

A stereo signal may contain a mixture of many sound sources for which the phantom images may appear to arrive from many directions, center, sides, and in between. In many applications it is important to separate the sources which generate the center phantom images. For example, surround sound reproduction standard formats typically use 3 frontal loudspeakers with a "hard-center" loudspeaker. If a two-channel stereo recording is reproduced on a surround loudspeaker system, the center channel needs to be generated artificially by extracting audio from the two-channels input signal, such as in matrix surround decoders (for example, see U.S. Pat. No. 4,799,260 to Mandell, et al.). In cinema applications it is important to separate dialogue audio, usually residing in the center direction, from the rest of the audio mixture, in order to make the dialogue clearer and more intelligible without substantially affecting the background and music. Further by way of example, in karaoke applications one of the desired features is the ability to obtain a common song and to eliminate from it the lead vocals, which usually reside in the center direction.

In other applications, when applying an artificial sound-effect to a stereo audio signal, the effect to be applied sometimes needs to change in accordance with the sound direction (or according to the phantom image direction). Such is the case for example when applying artificial acoustic filters to the audio (early reflections, Doppler effects), or when applying stereo widening effects (width matrix), or when applying virtualization effects (such as cross-talk cancellation, HRTF filter, dipole processing). In such cases, one may need to de-integrate the mixture into all its individual components of sound sources, and apply the desired effect separately to each. This task is considered difficult and scientifically virtually impossible. While some blind-source-separation methods ("BSS"), that attempt to "guess" the sound sources, do function in rather non-reverberant and well defined acoustics, modern stereo music already uses a complex mixture of microphone techniques, reverberant spaces, panning techniques, and a great amount of effects (linear and non-linear) that make BSS practically impossible. Also for this application, a more practical approach would be to separate only center sources from side sources. Since applying to the center sound sources (usually consisting primarily of vocals) a sound-effect which is designed for the sides would introduce audible artifacts to those center sources, separation of just the center sources may be effective for eliminating the artifacts. In the same manner, one may also apply an effect to the center sources only.

For many of the applications described above, there are two conditions which may be useful requirements or "ideals" for maintaining the sound reproduction of the processed stereo substantially faithful to the original stereo, for a system separating the center sources from the stereo mixture. For convenience, a mathematical representation of the two conditions is now provided by way of example. For input stereo L=left and R=Right, and for the separated 3-channels denoted center Cx, left Lx, and right Rx:

(1) Condition C1: L=Lx+g*Cx and R=Rx+g*Cx, with a gain g. A common value used for g is g=sqrt(½) hence the original stereo is reproduced back through split of the center energy between the left and the right channels.

(2) Condition C2: The stereo channel pair Lx,Rx, when reproduced separately from Cx, should sound to the ears of a human listener close to the original stereo pair L,R, for which the sounds arriving from the center have been omitted. Since this is considered virtually or practically impossible, the requirement is:

a. For any individual sound source in the center of the stereo reproduction of L,R, hence when L=R, it is expected that Cx=g1*L where g is a gain, and Lx=0 and Rx=0.

b. For any individual sound source fully-panned to any of the sides, hence L!=0 and R=0 or vise versa, it is expected that Cx=0 and Lx,Rx to maintain Lx=L and Rx=R.

Condition (C1) is important even when the summation does not happen in the music production, and the separated center sound channel Cx is transmitted as an individual channel. Note that when the 3-channel audio output is played back on a 2-channel system which many homes still have, conventional surround receivers and DVD players tend to mix the center channel back into the left and right channels. In surround sound this quality is usually called "stereo mix-down compatibility". The reproduction still needs to preserve the exact (or close to the exact) original stereo signal when summed back together. Also, in other applications as described above, when using center separation to apply an audio effect only to the sides or only to the center, it may be important to maintain a quality referred to herein as "transparency". Transparency essentially means that as the sound-effect is minimized the audio signal becomes as close as desired to the original.

Derived by the motivation of the applications described above, some prior art methods (such as disclosed for example by U.S. Pat. No. 4,748,669 to Klayman) separate the stereo signal into the scaled sum M=(L+R)/2 and scaled difference S=(L−R)/2, and apply some desired effect only to the scaled sum (M) or only to the scaled difference (S), then regenerate the stereo through the inverse transformation L=M+S and R=M−S. However, it should be noted that by taking the sum of the left and right stereo channels, hence the M=L+R signal, one does not extract the center sound sources from the stereo mix. For example, if a sound source was generated at the very left direction using amplitude-panning, then the right channel will be zero and we obtain M=L/2, thus M contains also half of the left-panned sound source. If one attempts to derive the separated Lx and Rx from the difference signal S, it would be apparent that for this approach condition (C2) does not hold.

Other systems that attempt to separate the center sound are surround matrix decoders. In such systems, the assumption is typically that most of the input stereo signals have been pre-encoded into the stereo to localize particular sound events in a surround multi-channel system. Resulting from this assumption and from the requirement with respect to the output of the decoders to preserve the directions of the original surround, the matrix decoders must localize, at each instant in time, the sound to only one given direction. It is then obvious that for a common case of a 2-channels stereo input containing a complex mixture of events and directions, the condition (C1) does not hold.

SUMMARY OF THE INVENTION

Thus, in accordance with some embodiments of the present invention there is provided a system, a method and a circuit for processing a stereo audio signal. According to some embodiments of the present invention, the system for processing a stereo audio signal may include an audio processing circuit. The audio processing module or circuit may be operatively connected to an audio input interface. Through the audio input interface, the audio processing circuit may be adapted for receiving a 2-channels stereo audio signal. The audio processing module may be adapted for determining an output mono audio signal representing the center sound and a stereo audio signal representing the stereo sound without the center. In some embodiments, the system may also include an output interface for providing an output of the audio processing circuit. In some embodiments, the output interface may provide each of the output mono audio signal representing the center sound and the stereo audio signal representing the stereo sound without the center. For convenience, in the following description the use of the term "audio processing circuit" relates also to an audio processing module.

In accordance with further embodiments of the present invention, there is provided an audio processing circuit that is adapted for receiving a 2-channels stereo audio signal. In some embodiments, the audio processing circuit may include a center separation module. The center separation module may be adapted to separate the input stereo signal into an intermediate mono audio signal representing a center sound and an intermediate stereo audio signal representing a stereo sound without the center as is described in further detail below. According to further embodiments of the invention, the output stereo signal is obtained by an adder summing each channel of the intermediate stereo to a constant gain multiplied by said intermediate mono signal.

In accordance with some embodiments of the present invention, the processing circuit includes an input adder and an input subtractor. The input adder is adapted to provide a scaled sum signal of an input stereo signal and the input subtractor is adapted to provide a scaled difference of an input stereo signal. According to further embodiments, a first 2-channels audio path feeds the sum and the difference signals to a center detector module, and a second 2-channels audio path feeds the sum and the difference signals into a 3×2 output matrix. In some embodiments, the center detector outputs a control gain Gc to be used in the output matrix. In further embodiments, the output matrix is given by the formula (f3) provided below. According to still further embodiments, the output matrix outputs 3 channels of audio either to the 3 channels output or to the intermediate mono and the intermediate stereo signals.

In accordance with further embodiments of the present invention, the processing circuit includes an input adder and an input subtractor. The input adder is adapted to provide a scaled sum signal of the input stereo signal. The input subtractor is adapted to provide a scaled difference of the input stereo signal. According to further embodiments, the sum and the difference signal are each fed to a cross-over band-split filter yielding two or more frequency bands signals for the sum and two or more frequency bands signals for the difference. According to still further embodiments, for each band j, a first 2-channels audio path feeds the sum and the difference signals to a band's center detector module, and a second 2-channels audio path feed the sum and the difference signals into a band's 3×2 output matrix. In some embodiments, the band's center detector outputs a band's control gain Gc(j) to be used in the band's output matrix. According to yet further embodiments, the band's output matrix is associated with the formula (f3) described below, and wherein each of the band's output matrix outputs 3 channels of audio. In some embodiments, all of the bands' 3-channels outputs are summed respectively using three output adders. In still further embodiments, the 3-channels output from the adders are fed to either output or to said intermediate mono and intermediate stereo signals. It should also be noted that, being linear, the order of the output adders and subtractors may be interchanged with the summation of the intermediate mono and the intermediate stereo.

In accordance with some embodiments of the present invention, the center detector is adapted to receive a sum signal and a difference signal and to output a gain control signal Gc. In some embodiments, the sum signal is fed into a first envelope detector and the difference signal is fed into a second envelope detector. The first envelope and the second envelope may be fed into a gain-computation formula yielding an unsmoothed gain. The unsmoothed gain may be fed into a smoothing filter yielding the gain control signal Gc.

In accordance with some embodiments of the present invention, the gain-computation formulae are configured to maintain conditions (C3) and (C4) provided below. In accordance with further embodiments, the gain-computation formulae are selected in accordance with conditions (C3) and (C4).

In accordance with some embodiments of the present invention, said gain-computation formula is given by the formula (f4) provided below.

Thus it would be appreciated, that according to some embodiments of the invention, the processing performed by the audio processing module may give rise to conditions (C1) and (C2) being met, or at least the results which are made possible from the implementation of the teachings of some embodiments of the present invention draw near to the ideals or results implied or prescribed by conditions (C1) and (C2) in a way that may be advantageous in sound production and reproduction, for example, by virtue of allowing to obtain backward compatibility of the 3-channels output with the conventional stereo input in both while obtaining good separation between center and sides.

According to certain embodiments of the present invention, it may be advantageous to apply said center detector and/or said output matrix to split stereo signal L,R into 3 channels Lx,Rx,Cx.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

Figure 1:
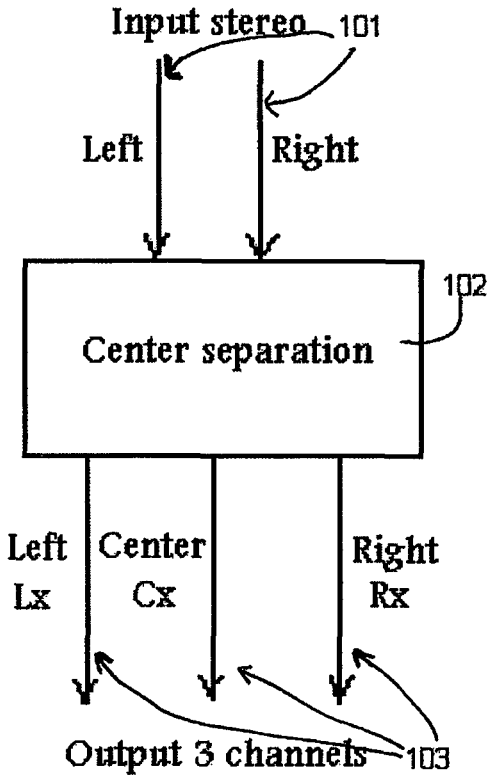
FIG. 1 is an illustration of a generic implementation of center separation for applications outputting 3 frontal channels, according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Provided below is a list of conventional terms. For each of the terms below a short definition is provided in accordance with each of the term's conventional meaning in the art. The terms provided below are known in the art and the following definitions are provided for convenience purposes. Accordingly, unless stated otherwise, the definitions below shall not be binding and the following terms should be construed in accordance with their usual and acceptable meaning in the art.

Phantom Image—The virtual sound-source generated in reproduction of stereo sound via two or more loudspeakers. A phantom image may be located in front or behind a listener.

Stereo Image—The totality of phantom images in stereo reproduction, including images from behind the listener.

Panning—The act or process of manipulating the phantom image direction of a monophonic source in stereo reproduction by routing the mono signal into both channels of the stereo, and by manipulating some parameters of the signal, such as the relative amplitudes of the channels or their relative phase or delays.

Stereo width—The perceived angular span between the leftmost and the rightmost phantom images in a stereo image.

Width matrix—A technique known in the art for controlling the stereo width.

HRTF—Head Related Transfer Function is a mathematical model which is known in the art for simulating some aspects of the propagation of sound through the air in a certain listening environment relating to the human head and/or ears.

Binaural recording—A known stereo recording technique, which involves placing microphones on an artificial (dummy) human head.

Cross-Talk Cancellation—A method for stereo monitoring using two or more loudspeakers, designed to substantially prevent sound or audio information from side loudspeakers from reaching a location opposite a listener's ear (the ear which is opposite (at least to some degree) to that loudspeaker(s) location). Cross-Talk Cancellation is typically attained through the use of various signal processing techniques to calculate an acoustic signal which is intended to cancel out the cross-talk between loudspeakers located on opposite sides, and adding that acoustic signal to each of the relevant loudspeakers' output.

Dipole filter/Dipole processing—A stereo cross-talk cancellation method designed and typically used in cases where the loudspeakers are substantially closely-spaced and are similar or identical.

Sweet-Spot—The area of best head position, in which listening to stereo or surround reproduction via loudspeakers is considered to be optimal and where the stereo/surround effect is well perceived.

Direct sound—In a room: the shortest sound path between the source and the listener not reflecting from any wall or object. In the field of electronic audio processing: direct sound relates to the unprocessed sound path.

Reverberation—The acoustic response of a surrounding space to a sound source, typically including reflections from walls and objects, and typically not including the direct sound. Reverberation of a point source measured at the listening point is closely described by a linear filter, that adds to the direct sound filter to generate the overall acoustic filter.

Early Reflections—The early arriving sound portion of the reverberation typically related to sound reflected from walls and objects.

Crossover filter—A set of two or more filters, separating the frequency domain into bands, where the sum of the frequency responses of all the filters is an all-pass filter or approximately an all-pass filter.

Some embodiments of the present invention relate to a system a method and a circuit for processing an audio signal. In reference to FIG. 1, in some embodiments of the present invention, a center separation module 102 receives a stereo audio input signal 101, denoted left and right channels, and outputs 3 channels of audio signals 103. In some embodiments, and by way of example, of the 3 output audio signals the left and right channel-pair (Lx, Rx) are intended for reproduction on a stereo audio reproduction system, and center Cx contains audio information intended for reproduction on a center-position additional loudspeaker. According to further embodiments of the invention, the center channel Cx may be separated from the other, non-center channel(s), such as the left and right channel, and may be summed back to each or some of the other channels, possibly after these channels have undergone some intermediate processing.

Figure 2:
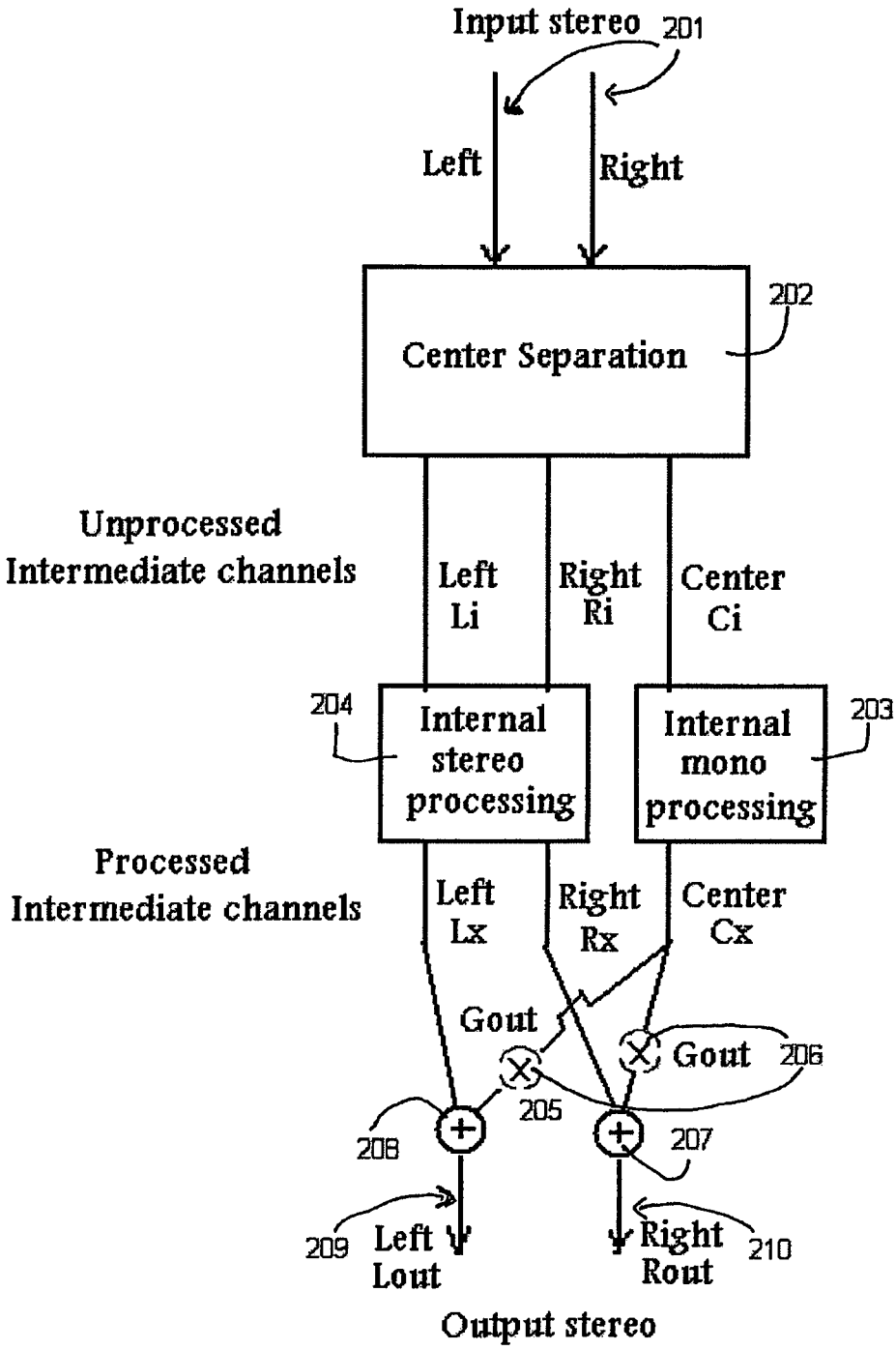
FIG. 2 is an illustration of an exemplary implementation of center separation for applications outputting 2-channels stereo and using center separation for internal processing, according to some embodiments of the invention.

Turning now to FIG. 2, which is an illustration of an exemplary implementation of center separation for applications outputting 2-channels stereo and using center separation for internal processing, according to some embodiments of the invention. In some embodiments of the present invention, a center separation module 202, which is described in greater detail below, is adapted to receive a stereo audio input signal 201, denoted left and right channels. The center separation module is adapted to output 3 unprocessed intermediate audio channels Li, Ri, and Ci. An internal stereo processing procedure implemented by a stereo processing module 204 may then be applied to the channel-pair (Li, Ri) to obtain processed intermediate audio channels Lx and Rx. An internal mono processing procedure implemented by a mono processing module 203 may be applied to Ci. The result of the internal mono processing procedure on Ci may give rise to a processed intermediate audio channel Cx. Cx is then summed to Lx by an adder 208 with gain Gout 205, giving rise to an output left channel Lout 209. Cx is also summed to Rx by a second adder 207 with second gain Gout 206, giving rise to an output right channel Rout 210. As a non-limiting example, the internal stereo processing procedure may include stereo enhancement or stereo virtualization effects, and/or the internal mono processing procedure may include voice enhancement effects.

Figure 3:
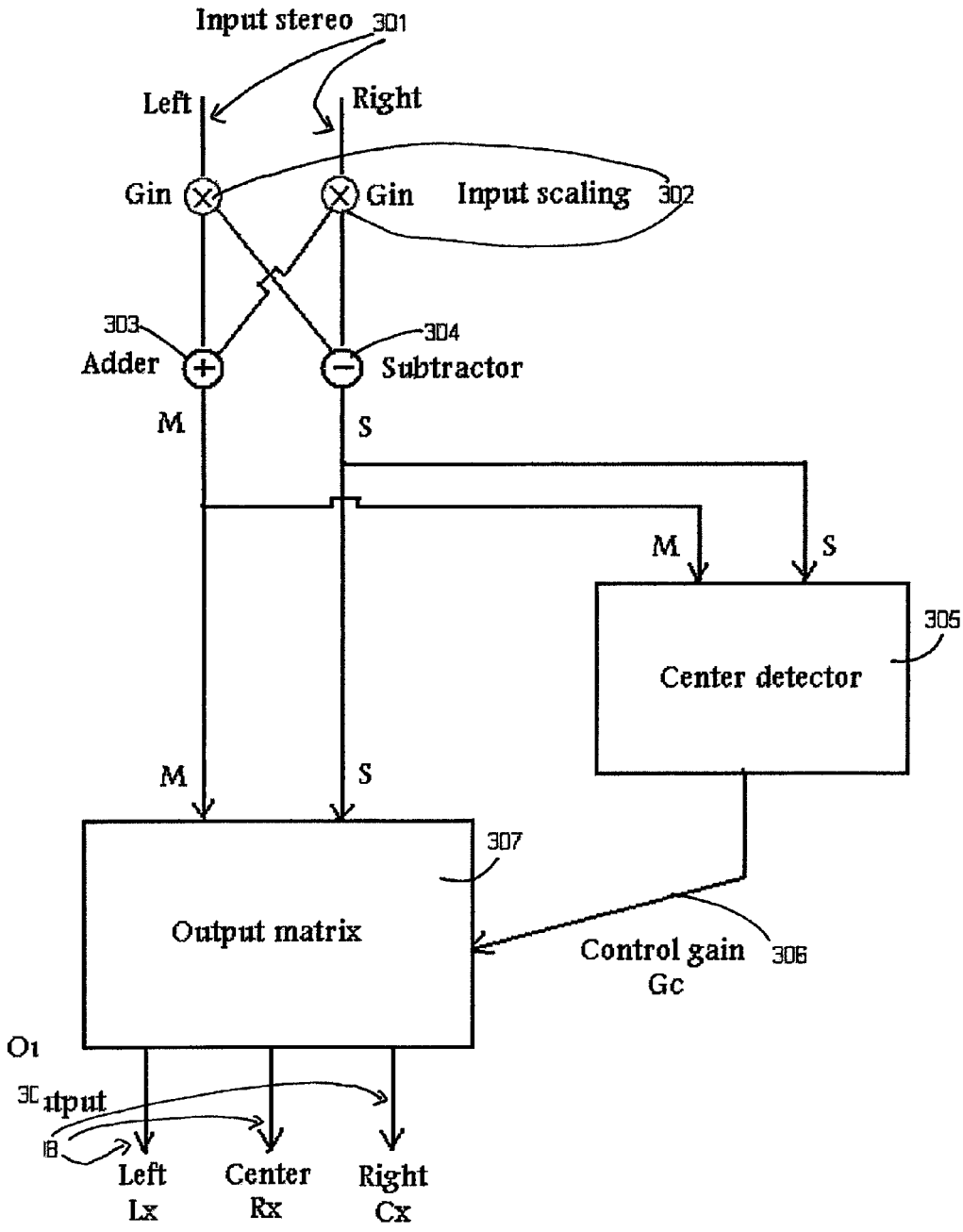
FIG. 3 is a block diagram illustration of an audio processing circuit, in accordance with some embodiments of the present invention.

In accordance with some embodiments of the present invention, there is provided an audio processing circuit including a center separation module. In reference to FIG. 3 showing a center separation module 305 in accordance with some embodiments of the invention, a stereo input signal 301 is fed into an input adder 303 and an input subtractor 304, possibly through an input gain Gin 302, yielding a sum signal M and a difference signal S. For convenience, mathematical representations for the sum signal M and for the difference signal S formulas are now provided:

$$M=(\text{Left}+\text{Right})*\text{Gin} \qquad \text{formula (f1)}$$

$$S=(\text{Left}-\text{Right})*\text{Gin} \qquad \text{formula (f2)}$$

where Left and Right are the channels of the input audio stereo signal, and where the gain Gin is optional. A possible non-limiting example for Gin is 0.5. It would be appreciated by those versed in the art that a gain parameter Gin=0.5 may be used to limit M and S to the same value range as the Left and Right inputs. The signals M and S are then fed into a center detection module. The center detection module 305 may be part of the center separation module and examples of both modules are described below. The signals M and S are also fed into an output matrix 307, which may be time variant. The center detector 305 outputs a control gain Gc 306, and the control gain Gc is used in the computation of the output matrix 307. In the output matrix, the signals M and S are multiplied by the matrix giving rise to the 3-channels output 308 Lx,Rx and Cx.

Figure 5:
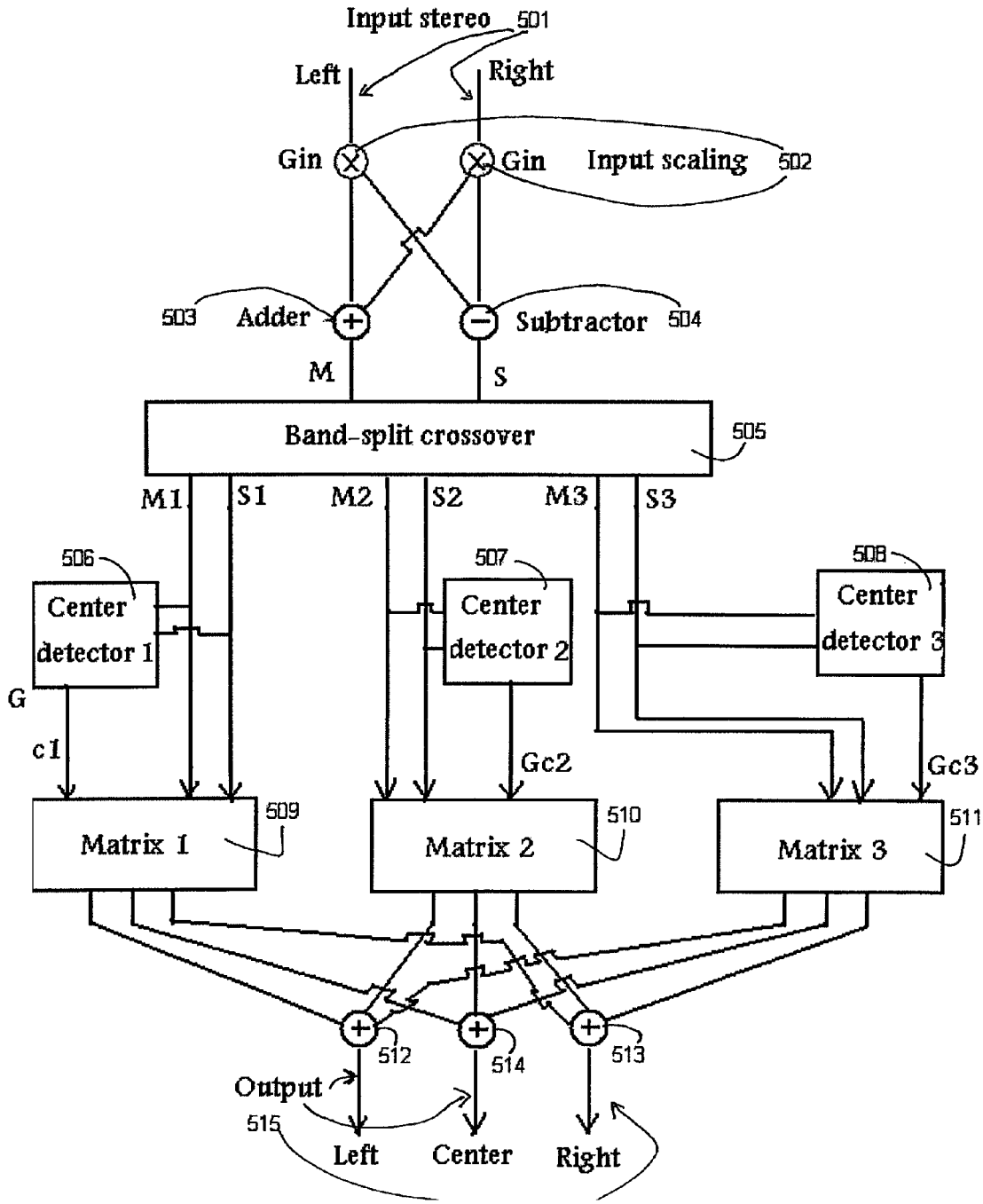
FIG. 5 is a block diagram illustration of an audio processing circuit, in accordance with further embodiments of the present invention, describing a multi-band approach with an example of 3 bands.

In accordance with further embodiments of the present invention, there is provided an audio processing circuit including a multi-band center separation module. FIG. 5 is a block diagram illustration describing a multi-band center separation module according to some embodiments of the invention. With reference to FIG. 5, a stereo input signal 501 is fed into an input adder 503 and an input subtractor 504, possibly through an input gain Gin 502, yielding a sum signal M and a difference signal S which were represented above by the formulae (f1) and (f2), respectively. The use of Gin is optional. The signals M and S may then be fed into two sets of band-split crossover filters 505. The crossover filters may operate on both M and S, yielding two or more frequency bands Mj j=1 . . . N from M and two or more frequency bands Sj j=1 . . . N from S. For illustration purposes, FIG. 5 describes the case of N=3 frequency bands. For each band j, the signals Mj and Sj are fed into a band's center detector module 506 507 and 508 (a dedicated center detector may be provided for each band). An example of such a detector is described below. Each band j is also fed into a band's output matrix 509 510 and 511, which may be time variant. Each band's center detector j outputs a control gain Gcj of that band to be used as part of the computation of that band's output matrix. In each band's output matrix, the signals Mj and Sj are multiplied by the band's matrix to yield the 3-channels band's output Lxj,Rxj and Cxj. All the Lxj for all j are then summed by an adder 512 into the output left channel Lx, and all the Rxj for all j are then summed by an adder 513 into the output right channel Rx 515, and all the Cxj for all j are then summed by an adder 514 into the output center channel Cx 515.

Figure 4:
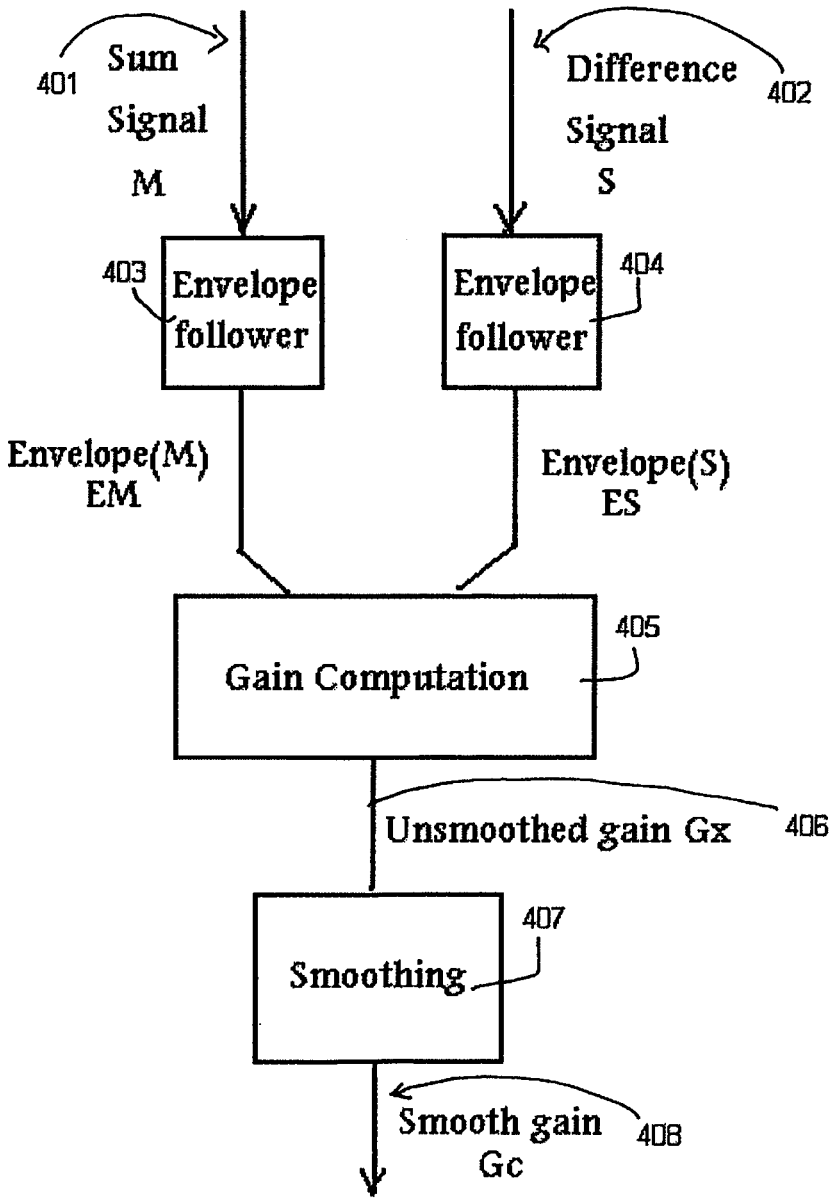
FIG. 4 is a block diagram illustration of a center detector module, in accordance with some embodiments of the present invention.

FIG. 4 illustrates one example of an implementation of a center detector module, according to some embodiments of the invention. According to some embodiments of the invention, the sum signal M 401 is fed into a first envelope follower 403 yielding envelope signal EM, and the difference signal S is fed into a second envelope follower 404 yielding envelope signal ES. Both EM and ES signals are then fed into a gain computation module 405 yielding an unsmoothed control gain Gx 406. According to further embodiments of the invention, the Gx may then be fed into a smoothing filter 407, yielding a smoothed gain signal Gc 408.

In accordance with further embodiments of the present invention, and as a non-limiting example, the envelope follower in a center detector module may include an absolute value operation followed by a low-pass filter.

In accordance with further embodiments of the present invention, and as a non-limiting example, the smoothing filter in a center detector module may include a low-pass filter.

In accordance with further embodiments of the present invention, each output matrix, given the control gain Gc, may be computed in accordance with the following formula:

$$Mat(Gc) = \begin{Bmatrix} 1-G_c & 1 \\ G_c & 0 \\ 1-G_c & -1 \end{Bmatrix} \quad \text{formula f3}$$

Where Mat(Gc) is the output matrix, Vms is the column vector (M, S) at the matrix input, Vout is the column vector (Lx, Cx, Rx) at the matrix output, and Vout=Mat(Gc)*Vms. Alternatively this matrix may be implemented through direct computation of the elements of Vout.

Referring now to FIG. 5, it should be noted that in an equivalent implementation, the output band's matrices may be partially interchanged with the output summation for the channels Lxj, Rxj, and Cxj, in the following manner: each band's matrix is replaced with a band's Mj_1=Mj*Gc and a band's Mj_2=Mj*(1−Gc), then all the signals Sj are summed to an intermediate output Sx, and all the signals Mj_1 are summed to the output Cx, and all the Mj_2 are summed to an intermediate output Mx. The output channel Lx is obtained by Lx=Mx+Sx, and the output channel Rx is obtained by Rx=Mx−Sx.

In accordance with further embodiments of the present invention, the formula of each gain computation module, implemented by each center detector module, may be generated by any formula fulfilling the following conditions:

condition (C3) when EM!=0 and ES=0, then Gx~0 condition (C4) when EM!=0 and abs(EM)=abs(ES), then Gx=1

Wherein the computed gain is Gx, and EM and ES are the sum and difference envelope signals respectively at the input to the gain computation module.

In accordance with further embodiments of the present invention, conditions (C3) and (C4) may be enhanced so that instead of the comparison of EM or ES to exactly 0, ES and EM are tested to have some minimum energy. Below that minimum they are considered 0 and above it they are considered to be unequal to 0.

In accordance with further embodiments of the present invention, conditions (C3) and (C4) may be augmented so that in addition it is further required that:

condition (C5) when ES!=0 and abs(EM)>abs(ES), then 0<Gx<1 and Gx is monotonic in abs(ES).

In accordance with further embodiments of the present invention, and as a non-limiting example, the formula of each gain computation module, inside each center detector module, may be computed by:

$$Gx=(ES+A)/(\max(ES,EM)+A) \quad \text{formula (f4)}$$

wherein the computed gain is Gx, A is a constant, and EM and ES are the sum and difference positive envelope signals respectively at the input to the gain computation module.

Some further embodiments of the invention include expanding formula (f4) with a gain mapping function. As two non-limiting examples, a linear gain mapping function may be used, such as:

$$Gmapped=b*Gx+c$$

or a non-linear mapping function such as $$Gmapped=a*Gc^2+b*Gx+c$$

Wherein a, b, and c are constants.

As part of some embodiments of the present invention, the audio processing circuits herein described may be utilized and integrated within a circuit or system intended for obtaining surround sound or multi-loudspeaker stereo based on conventional stereo input, and may also be used as a part of a circuit or system intended for providing stereo effect enhancement or stereo virtualization, possibly based on conventional stereo input.

In accordance with some embodiments of the present invention, the audio processing circuit may further include one or more of the following: additional filters, and/or width matrices, and/or digital delays, and/or all-pass filters, and/or additional gains. Those versed in the art would be readily capable of integrating and utilizing any one or any combination of the above components with various embodiments of the present invention.

It will also be understood that throughout the description provided herein, the audio processing circuit may be implemented in computer software, a custom built computerized device, a standard (e.g. off the shelf computerized device, such as an FPGA circuit) and any combination thereof. Likewise, some embodiments of the present invention contemplate a computer program being readable by a computer for executing the method of the invention. Further embodiments of the present invention contemplate a machine-readable memory tangibly embodying a program of instructions executable by the machine for executing the method in accordance with some embodiments of the present invention.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. An audio processing circuit comprising:

an input adder and an input subtractor adapted to receive an input stereo signal and to provide a sum signal and a difference signal respectively a center sound detector, comprising:

a first envelope follower applied to the sum signal and a second envelope follower applied to the difference signal;

a gain computation module adapted to compute an unsmoothed gain signal in accordance with conditions when EM≠0 and ES=0, then Gx~0, where the .computed gain is Gx, and EM and ES are the sum and difference envelope signals respectively at the input to the gain computation module; and when EM≠0 and abs(EM).=abs(ES), then Gx=1 from outputs of said first and second envelope followers; and a smoothing filter adapted to smooth the unsmoothed gain signal, giving rise to a smoothed control gain; and a variable output 3×2 matrix Mat(Gc) controlled by said smoothed control gain and adapted to provide an output stereo signal and an output mono center signal based on said sum and difference signals.

2. The system according to claim 1, wherein said variable output matrix Mat(.Gc) is implemented in accordance with formula $$Mat(Gc) = \begin{pmatrix} 1-Gc & 1 \\ G & 0 \\ 1-Gc & 1 \end{pmatrix}.$$

3. The system according to claim 1, further comprising:

a first and a second set of cross-over band-split filter, each adapted to provide two or more frequency band signals, wherein said sum signal is fed to first said split filter set, and said difference signal is fed to second said split filter set, and wherein each output band of both said split filters sets is fed into said output matrix for that band, and also fed to said center detector for that band, and wherein said band's control gain controls said band's output matrix, and wherein for each band outputs of said band's output matrix are summed into said output stereo signal and said output mono signal, and wherein inside each said center detector said sum signal is fed into first said envelope detector and said difference signal is fed into second said envelope detector, and wherein said gain computation module computes unsmoothed gain from outputs of said first and said second envelope detectors, and wherein said unsmoothed gain is fed into said control smoothing filter yielding said band's smoothed control gain, and wherein each said gain computation module computes gain according to condition when EM≠0 and ES=0, then Gx~0 and condition, when EM≠0 and abs(EM)=abs(ES), then Gx=1, and wherein said output matrix is computed according to formula $$Mat(Gc) = \begin{pmatrix} 1-Gc & 1 \\ G & 0 \\ 1-Gc & 1 \end{pmatrix}.$$

4. The system according to claim 1, wherein said first stereo output signal and said first mono output signal are further combined to yield a second stereo output signal by summing scaled said output mono signal into both channels of said first output stereo.

5. The system according to claim 1, wherein said first stereo output signal and said first mono output signal are further combined to yield a second stereo output signal by first applying some first audio processing to first output stereo signal yielding processed stereo, and applying some second audio processing to said first mono output signal yielding processed mono and summing scaled said processed mono signal into both channels of said processed output stereo.

6. The system according to claim 1, wherein said input adder and said input subtractor and coefficients of said output matrix and said gain computation module are each scaled by constant gains.

7. The system according to claim 1, wherein said gain computation module of said center detector is implemented to also comply with condition when ES≠0 and abs(EM)> abs(ES.), then 0<Gx<1 and Gx is monotonic in abs(ES).

8. The system according to claim 1, wherein said gain computation module of said center detector is implemented in accordance with formula Gx=(ES+A)/(max(ES,EM)+A), where A is a constant.

9. The system according to claim 1, wherein said gain computation module includes both formula Gx=(ES+A)/(max(ES,EM)+A), where A is a constant and an additional gain mapping function maintaining conditions when EM≠0 and ES=0 then Gx~0 and when EM≠0 and abs(EM)=abs(ES), then Gx=1, where A is a constant.

10. The system according to claim 3, wherein some computation from output matrix for each band is interchanged in order with said output summation in a way that maintains identity of the output signal.

11. The system according to claim 1, wherein said input signal is a stereo signal and wherein said output signal is a surround sound including frontal channels computed at least in part based on the output of the variable output 3×2 matrix and based on said smoothed control gain.

12. The system according to claim 5, wherein said first audio processing includes applying stereo enhancement effect and wherein said second audio processing is bypass.

13. A method of processing a stereo audio signal, comprising:

receiving an audio signal;

computing sum and difference of said input audio signal;

computing a time-variant control gain from said sum and difference using a gain computation maintaining condition when EM≠0 and ES=0, then Gx~0, where the computed control gain is Gx, and EM and ES are the sum and difference envelope signals respectively at the input to the gain computation module and condition when EM≠0 and abs(EM)=abs(ES), then Gx=1 as well as using smoothing filters to sum and difference signals and/or to the result control signal of gain computation; and processing said sum and difference signals to obtain 3 output channels using a matrix Mat(Gc) as in formula $$Mat(Gc) = \begin{pmatrix} 1-Gc & 1 \\ G & 0 \\ 1-Gc & 1 \end{pmatrix}$$

using said control gain from gain computation.

* * * * *